US005971797A

United States Patent [19]

Straub, Jr. et al.

[11] Patent Number: 5,971,797

[45] Date of Patent: Oct. 26, 1999

[54] CONNECTOR WITH CABLE STRAIN RELIEF

[75] Inventors: Paul John Straub, Jr., Mooresville; Cherie L. Wolfe, Greenwood, both of Ind.

[73] Assignee: Lucent Technologies Inc., Murray Hill, N.J.

[21] Appl. No.: 09/042,471

[22] Filed: Mar. 16, 1998

[51] Int. Cl.[6] ..... H01R 13/58

[52] U.S. Cl. ..... 439/468; 439/459

[58] Field of Search ..... 439/456, 468, 439/460, 608, 449–455, 457–459, 461–471

[56] References Cited

U.S. PATENT DOCUMENTS

| | | | |
|---|---|---|---|
| 3,148,928 | 9/1964 | Noschese et al. | 439/472 |
| 3,794,960 | 2/1974 | Sugar | 439/468 |
| 4,244,638 | 1/1981 | Little et al. | 439/471 |
| 4,405,187 | 9/1983 | Muller et al. | 439/608 |
| 4,761,145 | 8/1988 | Goto et al. | 439/469 |
| 4,822,286 | 4/1989 | Bianca | 439/460 |
| 5,562,479 | 10/1996 | Pallas et al. | 439/456 |

*Primary Examiner*—Gary F. Paumen
*Assistant Examiner*—Briggitte R. Hammond

[57] ABSTRACT

A cable strain relief connector has a generally rectangular, elongated connector body with a terminal face at a front side of the body for engaging terminals of a mating connector, and a cable end face at a rear side of the body. The connector body has mounting fastener openings at each end of the length of the body for receiving fasteners for mounting the connector body in electrical connecting relation the mating connector. A cable strain relief clamp is seated on the cable end face of the connector body and extends over the cable end face between the fastener openings at each end of the connector body.

15 Claims, 2 Drawing Sheets

CONNECTOR WITH CABLE STRAIN RELIEF

BACKGROUND OF THE INVENTION

1. Field of the Invention

The present invention relates to electrical connectors with provisions for cable strain relief, and particularly to a connector wherein a cable strain relief clamp is seated on the connector body.

2. Discussion of the Known Art

It is generally known to incorporate cable strain relief hardware in an electrical connector. Such hardware acts to grip an end of a cable, and to hold the cable end steady relative to the connector. Individual cable wires at the cable end are routed over the connector body to corresponding connector terminals. Strain relief hardware may also be configured to support the cable end at a desired angle with respect to the connector. A known 25 wire-pair connector has a cable strain relief clamp that supports a cable at an acute angle relative to the connector's terminal face, and is available from Superior Modular Products.

A problem exists with the mentioned cable strain relief type connector, however. Specifically, a strain relief clamp associated with the connector is seated at one side end of the connector body. The seated part of the clamp overlies a connector mounting screw hole at the side end, thus making it impossible to insert a mounting screw in the hole conveniently from the direction of the cable side of the connector. That is, only one end of the known connector is accessible to a mounting screw from the cable side. And, once mounted on a mating connector, the other end of the known connector must be secured by less convenient means such as a cable tie-down. Use of the known strain relief cable connector is therefore considerably more difficult and time-consuming in the field, when compared to other cable connectors whose mounting screws can be installed or removed entirely from the cable side. See also U.S. Pat. No. 4,405,187 (Sep. 20, 1983) which relates to a connector construction for PCM cables.

SUMMARY OF THE INVENTION

According to the invention, a cable strain-relief connector includes a generally rectangular, elongated connector body having a terminal face at a front side of the body for engaging terminals of a mating connector, and a cable end face at a rear side of the body. The connector body has a mounting fastener opening at each end of the length of the body, to receive respective fasteners for mounting the connector body in electrical connecting relation with the mating connector. A cable strain relief clamp is seated on the cable end face of the connector body and extends over the cable end face between the fastener openings at each end of the connector body.

For a better understanding of the invention, reference is made to the following description taken in conjunction with the accompanying drawing and the appended claims.

DETAILED DESCRIPTION OF THE INVENTION

Figure 1:
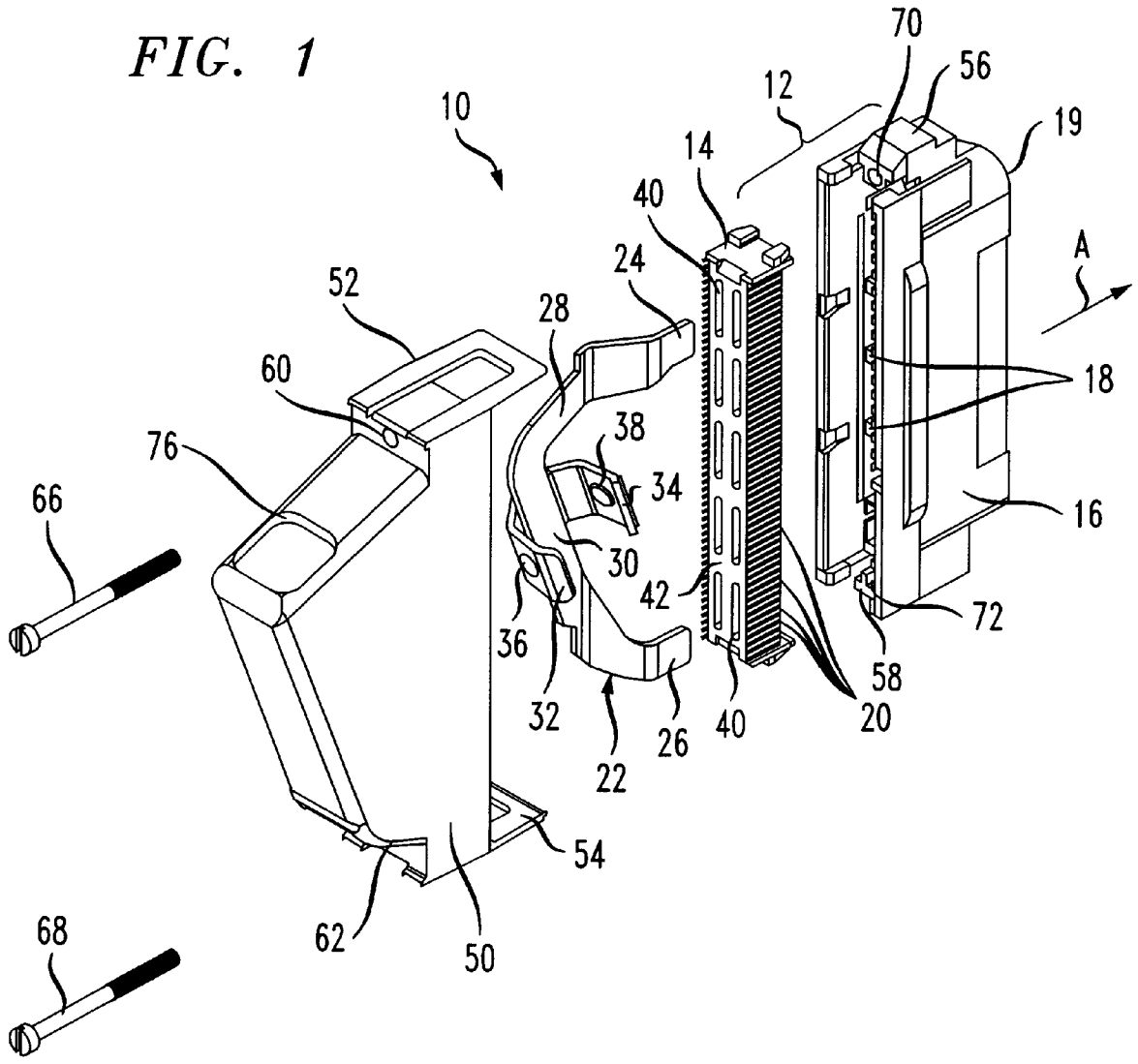
FIG. 1 is a perspective, assembly view of a connector according to the invention.
Figure 2:
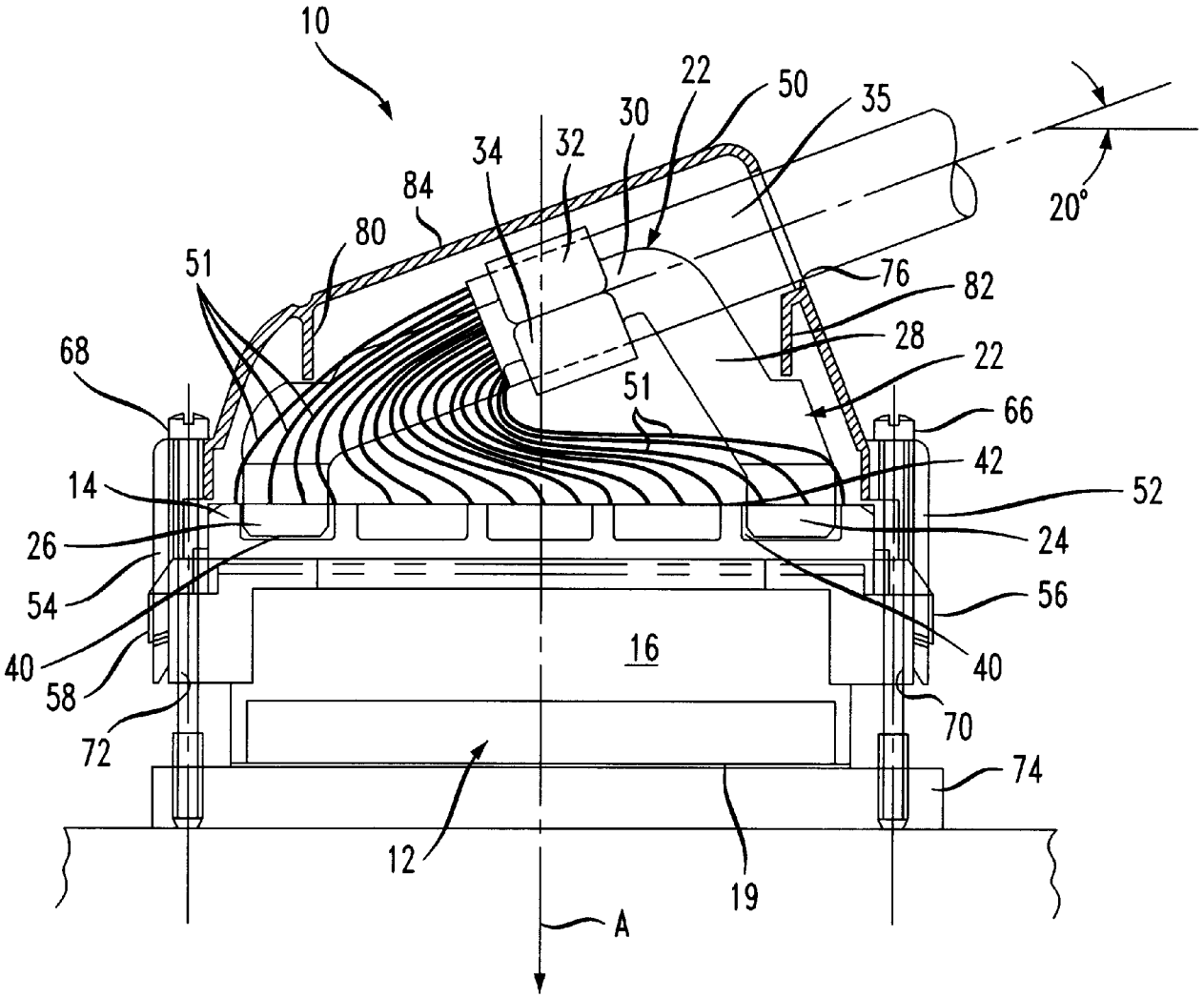
FIG. 2 is a side elevation view, partly in section, of an assembled connector according to the invention.

FIG. 1 shows a cable strain relief connector 10 according to the invention. FIG. 2 is a side elevation view of the assembled connector 10.

The connector 10 includes a generally rectangular, elongated body 12. In the illustrated embodiment, the body 12 is formed of three parts, namely, a mandrel 14, a connector terminal housing 16, and a fanout containing a number, e.g., 25 pairs of connector terminals 18 aligned in two parallel rows. The connector body 12 has a terminal face 19 at a front side of the body for engaging terminals of a mating connector 74 shown in FIG. 2.

As is known in the art, insulated cable wires to be connected electrically with the terminals 18 in the connector housing 16 (see FIG. 2), are wrapped in grooves 20 formed on outside walls of the mandrel 14. Once the cable wires are wrapped about the mandrel 14, the mandrel is pressed into the connector housing 16 causing the cable wires to connect electrically with corresponding terminals 18. The terminals have associated teeth that pierce or displace the insulation on the cable wires thus making electrical connections between the wires and the terminals. See, for example, U.S. Pat. No. 5,562,479 (Oct. 8, 1996). All relevant portions of the '479 patent are incorporated by reference herein.

The connector 10 also has an associated cable strainrelief clamp 22. The clamp 22 can be formed, for example, from a sheet of zinc plated 19-gage cold rolled steel, No. 2 (half hard) temper, or other equivalent material. Clamp 22 is generally "U"-shaped with two leg ends 24, 26 that are joined by an integral bridge part 28 of the clamp 22. A clamp section 30 of the bridge part 28 extends relative to the leg ends 24, 26 in a direction that corresponds to an angle at which a cable end is to be attached to the connector 10, as explained below with respect to FIG. 2.

A pair of cable clamp ears 32, 34 project from opposite sides of the clamp section 30. Free ends of the clamp ears 32, 34 are spaced apart a sufficient distance to permit a jacketed cable end 35 to pass between the ears, and to allow the ears to be squeezed (or crimped) snugly about the circumference of the cable jacket, as seen in FIG. 2. To aid in fixing the cable end from relative movement on the clamp 22, the clamp ears 32, 34 preferably have associated dimples 36, 38 (FIG. 1) formed to hold the cable jacket in place.

The connector body 12 has elongate slots 40 in a cable end face 42 at a rear side of the connector body, on the mandrel 14. In the disclosed embodiment, two parallel rows of slots 40, with five slots aligned in the direction of each row, extend along the length of the cable end face 42 on the mandrel. The leg ends 24, 26 of the clamp 22 are dimensioned and formed to slide in and out of a pair of the slots 40, preferably the two end slots of either row of slots 40. With the relative orientation in the drawing, when the leg ends 24, 26 are seated in the end slots of the right row of slots 40 in FIG. 1, the cable end 35 will be aligned at an acute angle of, e.g., 20 degrees with respect to the terminal face 19 of the connector body. The cable end 35 will also form an angle of 110 (20+90) degrees, relative to a direction A in which the terminal face 19 is urged to engage the mating connector 74. See FIG. 2.

An important feature of the invention resides in allowing a user to select one of two opposite directions of cable approach relative to the connector 10. Specifically, the clamp 22 is preferably removable from the slots 40 to allow it to be "flipped" 180 degrees from the position shown in FIGS. 1 and 2. That is, the clamp leg end 24 can be inserted in slot 40 toward the lower left in FIG. 1, and leg end 26 can be inserted in the slot 40 toward the upper left in FIG. 1. This feature, together with a "reversible" connector hood 50 described below, allows a cable to approach the connector 10 at an angle from either side end of the connector, and, thus, best accommodate given mating connector terminal assignments and cable routing schemes.

The connector hood 50 encloses the strain-relief clamp 22, and the cable end 35 and associated cable wire leads 51.

See FIG. 2. The hood 50 is preferably made of a sturdy plastics material meeting all applicable standards, especially with respect to flammability. A pair of resilient loop snaps 52, 54 project forward from side ends of the hood 50, and the snaps 52, 54 have openings for receiving corresponding block protrusions 56, 58 at opposite side ends of the connector terminal housing 16. The hood 50 also has a pair of fastener or screw holes 60, 62 in the region of the hood snaps 52, 54. The screw holes 60, 62 allow the bodies of a pair of connector screws 66, 68 to be inserted from outside the hood and pass through openings 70, 72 at opposite side ends of the connector housing 16. Threaded ends of the connector screws 66, 68 may then engage corresponding threaded openings in the body of the mating connector 74, and the screws 66, 68 can each be tightened from the direction of the cable side of the connector 10 to mount the connector 10 on the mating connector 74. Likewise, when the connector 10 is to be dismounted from the mating connector 74, each of the mounting screws 66, 68 can be loosened conveniently from the direction of the cable side of the connector 10.

The hood 50 also has a cable opening 76 to permit passage of the cable end 35 at the desired angle (e.g., 20 degrees) relative to the connector terminal face 19. As shown in both FIGS. 1 and 2, the overall shape of hood 50 conforms to the outer dimensions of the strain relief clamp 22 and the portion of on the connector body 12 on which the clamp 22 is seated.

Preferably, the hood 50 has a set of interior tongues 80, 82 depending downwardly from a top wall 84 of the hood 50. The hood tongues 80, 82 confront an upper edge of the strain relief clamp 22 at points aligned over the leg ends 24, 26 of the clamp. The tongues are dimensioned to hold the clamp 22 in a seated position on the cable end face 42 of the connector body 12, when the hood is fastened on the connector body via the screws 66, 68. As shown in the drawing, the upper edge of the clamp 22 is preferably stepped to accommodate confronting ends of the tongues 80, 82.

While the foregoing description represents a preferred embodiment of the invention, it will be obvious to those skilled in the art that various changes and modifications may be made without departing from the true spirit and scope of the invention pointed out by the following claims.

We claim:

1. A cable strain relief connector, comprising:

a generally rectangular, elongated connector body having a front side defining a terminal face on the connector body for engaging terminals of a mating connector, and a rear side defining a cable end face on the connector body for receiving cable wires to be connected electrically with the terminals of the mating connector;

a cable strain relief clamp seated on the cable end face of the connector body and extending above the cable end face along the direction of the length of the connector body;

wherein the strain relief clamp is formed of a rigid material and is generally U-shaped, and has a pair of leg ends and a bridge part that joins the leg ends; and a clamp section on said bridge part is constructed and arranged to be squeezed about the circumference of a cable end to restrain the cable end from relative movement with respect to the strain relief clamp, and to align the cable end in a direction that corresponds to an angle at which the cable end approaches the connector.

2. The connector according to claim 1, wherein the clamp section is configured to clamp said cable end so that the cable end forms an angle of about 20 degrees with respect to the terminal face of the connector body when the clamp is seated on said cable end face.

3. The connector according to claim 1, wherein said connector body and said strain relief clamp are formed and dimensioned so that said clamp can be seated on said cable end face in a selected one of two different operative positions.

4. The connector according to claim 1, wherein said cable end face has number of slots, and the leg ends of the strain relief clamp are formed to slide into and out of a pair of said slots.

5. The connector according to claim 1, wherein the connector body has a mating fastener opening at each end of the length of said body to receive respective fasteners for mounting the connector body to a mating connector, and the leg ends of the strain relief clamp are seated in the connector body at positions between the fastener openings at each end of the connector body.

6. The connector according to claim 1, wherein said clamp section has a pair of cable clamp ears that are spaced apart enough to permit the cable end to pass between the ears, and for said ears to be squeezed about the circumference of the cable end.

7. The connector according to claim 1, including a hood dimensioned and arranged to enclose the strain relief clamp and the cable end face of the connector body on which the clamp is seated.

8. The connector according to claim 7, wherein said hood has a pair of loop snaps projecting from corresponding side ends of the hood, said connector body has a pair of block protrusions on opposite side ends of the connector body, and the loop snaps have openings for receiving said block protrusions when the hood is operatively positioned on the connector body.

9. The connector according to claim 7, wherein said hood has a top wall and a number of interior tongues depending downwardly from said top wall to confront an bridge part of the strain relief clamp in the regions of the leg ends of the clamp.

10. The connector according to claim 9, wherein the upper edge of the clamp is stepped to accommodate confronting ends of said tongues.

11. A cable strain relief clamp for use with electrical connectors having an elongated body, a cable end face on the connector body and a number of slots aligned along the length of the cable end face, wherein said strain relief clamp is formed of a rigid material and is generally U-shaped, and has a pair of leg ends and a bridge part that joins the leg ends;

said leg ends are dimensioned and arranged to be seated in selected ones of the slots in the cable end face; and a clamp section on said bridge part is constructed and arranged to be crimped about the circumference of a cable end to restrain the cable end from relative movement with respect to the strain relief clamp, and to align the cable end in a direction that corresponds to an angle at which the cable end approaches the electrical connector.

12. The cable strain relief clamp according to claim 11, wherein the leg ends of the clamp are dimensioned and arranged to be removably insertable in said slots so that the clamp can be fixed over said cable end face in a selected one of two different operative positions.

13. The cable strain relief clamp according to claim 11, wherein said bridge part is stepped in the regions of the leg ends of the clamp, for abutting tongues inside of a connector hood.

14. The cable strain relief clamp according to claim 11, wherein the clamp is formed from a sheet of metallic material.

15. The cable strain relief clamp according to claim 14, wherein the metallic material is a plated cold rolled steel.

* * * * *